US007789035B1

(12) United States Patent
Rosenberg et al.

(10) Patent No.: US 7,789,035 B1
(45) Date of Patent: Sep. 7, 2010

(54) STABILIZER AND STANDING SUPPORT FOR A KAYAK OR CANOE

(76) Inventors: Richard H. Rosenberg, 3421 Edmondson Ct., Sarasota, FL (US) 34242; Harold J. Rosenberg, 4710 Maid Marian La., Sarasota, FL (US) 34232

( * ) Notice: Subject to any disclaimer, the term of this patent is extended or adjusted under 35 U.S.C. 154(b) by 0 days.

(21) Appl. No.: 12/473,543

(22) Filed: May 28, 2009

(51) Int. Cl.
*B63B 17/00* (2006.01)

(52) U.S. Cl. ..... 114/363; 114/347

(58) Field of Classification Search ..... 114/347, 114/363, 123; D12/317
See application file for complete search history.

(56) References Cited

U.S. PATENT DOCUMENTS

| | | | | |
|---|---|---|---|---|
| 1,683,276 | A * | 9/1928 | Woods | 114/61.16 |
| 3,990,743 | A | 11/1976 | Nelson | |
| 4,512,277 | A | 4/1985 | Williams | |
| 4,641,594 | A | 2/1987 | Birkett | |
| 4,803,945 | A | 2/1989 | Adams et al. | |
| 5,007,362 | A | 4/1991 | Balogh | |
| 5,134,953 | A | 8/1992 | Balogh | |
| 5,295,454 | A | 3/1994 | Streck | |
| 5,356,201 | A | 10/1994 | Olson | |
| D367,032 | S | 2/1996 | Fentress et al. | |
| 5,619,949 | A * | 4/1997 | Dick, Jr. | 114/363 |
| 5,784,983 | A | 7/1998 | Stegall | |
| 6,000,355 | A | 12/1999 | Hall | |
| D440,536 | S | 4/2001 | Grzybowski | |
| 6,305,306 | B1 * | 10/2001 | Grzybowski | 114/123 |
| D457,121 | S | 5/2002 | Gyzybowski | |
| 6,860,216 | B1 | 3/2005 | Morriseau | |
| 6,928,949 | B1 | 8/2005 | Simon | |
| 6,932,018 | B2 | 8/2005 | Slattebo | |
| 7,032,531 | B1 | 4/2006 | Caples | |
| 7,121,225 | B1 | 10/2006 | Caples | |
| 7,124,702 | B1 | 10/2006 | Cameron | |
| 7,182,030 | B2 | 2/2007 | Privette | |
| 7,334,534 | B2 | 2/2008 | Cameron | |
| 2007/0012236 | A1 | 1/2007 | Caples | |

* cited by examiner

*Primary Examiner*—Edwin Swinehart
(74) *Attorney, Agent, or Firm*—Charles J. Prescott

(57) ABSTRACT

A combination stabilizer and standing support for a kayak or canoe. A pontoon assembly is attachable to the deck of the kayak or canoe and provides a buoyant pontoon held laterally spaced from each side of the kayak or canoe for maintaining stability. A standing support also assembly attachable to the deck includes a body support elevated above the deck a distance sufficient to provide leaning support for a person standing in the kayak or canoe while fishing. A locking latch releasibly locks each pontoon arm in a pivotally downwardly deployed position placing the pontoons into water to stabilize the kayak or canoe from substantial rolling movement while a rope and pulley arrangement connected to each of the pontoon arms facilitates manually lifting of the pontoons above the water when not in use.

3 Claims, 11 Drawing Sheets

STABILIZER AND STANDING SUPPORT FOR A KAYAK OR CANOE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to water vessels, and particular kayaks, and more particularly to a system which will stabilize a kayak or a canoe and support a fisherman standing in the kayak during fishing activities.

2. Description of Related Art

The use of kayaks and canoes in fishing activities has become quite popular. The fisherman, while seated, may quietly paddle into very shallow, secluded waters which increases the opportunity for catching those big lunkers which lie in shallow, quiet water when other activity is at a minimum. However, in using a kayak or canoe, the fisherman must typically remain seated as the kayak or canoe can become quite unstable should the fisherman stand or become over activated and excited when landing a large fish.

A number of prior art devices teach the utilization of pontoons which are deployable from either side of a boat, including a kayak. These inventions serve to stabilize the kayak or canoe from excessive rolling motion along the longitudinal roll axis of the kayak. Birkett teaches an iceboat kit for converting a canoe to a sailboat whereby, when free of a canoe, the kit can be used alone as an iceboat and when mounted on a canoe the kit converts the canoe to a sailboat in U.S. Pat. No. 4,641,594. A stabilizer for a canoe or small boat is disclosed in U.S. Pat. No. 6,928,949 to Simon. U.S. Pat. No. 5,295,454 to Streck discloses a safety release for attaching an outrigger to a canoe. Cameron teaches a fishing kayak with a deployable fantail in U.S. Pat. No. 7,124,702.

Most fisherman, however, prefer the standing position while casting and retrieving lures and landing fish. Although many of the above references will stabilize the kayak from rolling, nonetheless the width of a kayak or canoe is extremely small and standing stability during fishing activities becomes problematic. A number of prior art devices are taught which assist in stabilizing a fisherman while being seated. U.S. Pat. No. 3,990,743 to Nelson discloses a back support assembly which is adapted for use in any conventional boat having a rigidly disposed seat. A fishing boat backrest and post mount is disclosed in U.S. Pat. No. 4,803,945 to Adams et al. Olson teaches an adjustable canoe or boat seat backrest in U.S. Pat. No. 5,356,201. An ornamental design for an adjustable supporting surface is disclosed in U.S. Patent Des. 367,032 to Fentress et al. U.S. Pat. No. 5,784,983 to Stegall discloses an adjustable standing back support apparatus for a boat.

The present invention provides a system which is easily retrofittable to a conventional kayak or canoe and which converts that kayak or canoe into one which is substantially stabilized from rolling motion by the use of pontoons which also may be lifted from the water when the kayak or canoe is to be repositioned or paddled to another location. This invention further combines a uniquely configured, easily deployable standing support assembly which will support a fisherman while leaning thereagainst about the mid-portion of the torso, providing great stability to the fisherman in both kayak or canoe rolling and lateral or pitching torso movement during virtually all aspects of fishing activity.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a combination stabilizer and standing support for a kayak or canoe. A pontoon assembly is attachable to the deck of the kayak or canoe and provides a buoyant pontoon held laterally spaced from each side of the kayak or canoe for maintaining stability of the kayak. A standing support also assembly attachable to the deck includes a body support elevated above the deck a distance sufficient to provide leaning support for a person standing in the kayak while fishing. A locking latch releasibly locks each pontoon arm in a pivotally downwardly deployed position placing the pontoons into water to stabilize the kayak from substantial rolling movement while a rope and pulley arrangement connected to each of the pontoon arms facilitates manually lifting of the pontoons above the water when not in use.

It is therefore an object of this invention to provide a simple, yet effective system for stabilizing a kayak or canoe from excessive rolling motion while also providing leaning support to the fisherman about the mid-torso so that virtually all aspects of fishing activity may be done with physical stability and confidence from the kayak or canoe.

Still another object of this invention is to provide a stabilizing system for both kayak or canoe and fisherman which is easily deployable onto a conventional kayak or canoe.

Yet another object of this invention is to provide a pontoon system and torso support assembly for stabilizing a kayak or canoe and supporting a fisherman while leaning against the torso support and during fishing activity and wherein the pontoons may be lifted completely free of the water and even elevated to a vertical position for rowing activity and tight clearance passage under bridges and narrows.

And another object of this invention is to provide a kayak or canoe stabilization system which facilitates all aspects of fishing activity and which is economical to manufacture and easily deployable onto conventional kayaks or canoes.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
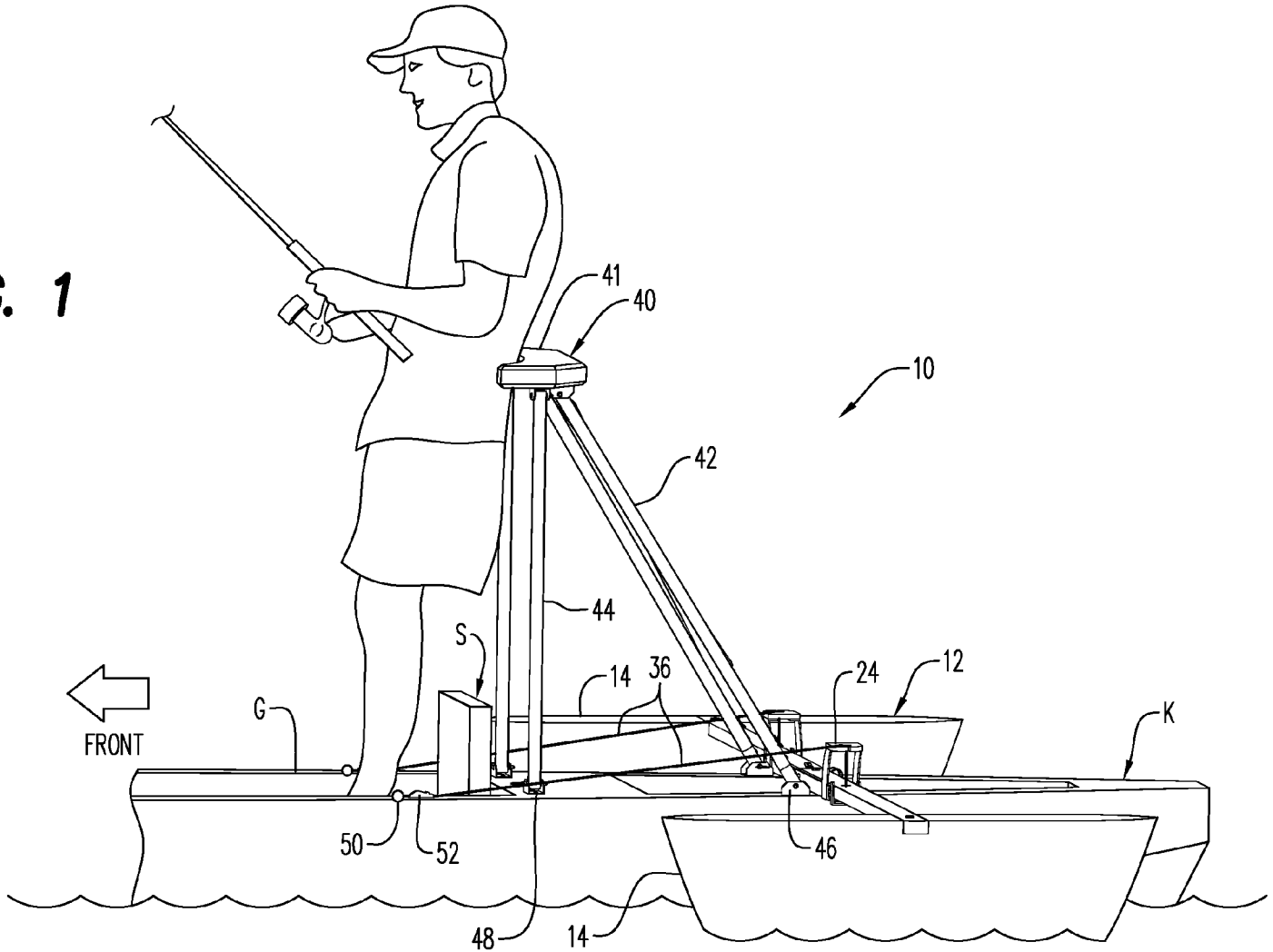
FIG. 1 is a side perspective broken view of a fisherman standing and leaning against the standing support assembly with the pontoon assembly fully deployed.

Exemplary embodiments are illustrated in reference figures of the drawings. It is intended that the embodiments and figures disclosed herein are to be considered to be illustrative rather than limiting.

LIST OF COMPONENTS

10. system
12. pontoon assembly
14. standing support assembly pontoon
16. pontoon arm
18. beam support member
20. pontoon beam pivot
20*a*. pontoon beam release pin
22. strut
24. rope guide plate
26. latch plate
28. latch
30. latch engagement
32. latch pivot
34. latch spring
36. lift rope
38. hole
40. standing support assembly
41. bodysupport
42. rear strut
43. cross brace
44. front strut
46. rear strut deck anchor
48. front strut deck anchor
50. knob
52. deck cam cleat
54. front strut anchor
56. rear strut anchor
58. front strut release pin
60. fastener
62. reinforcing tube
64. release pin hole
64*a*. pontoon attaching bolt
66. pontoon mounting slot
70. pulley tower
72. upright tower frame
74. upper pulley
76. tower top
78. lower pulley
80. tower base
81. mounting surface
D deck
G gunnel
K kayak
S seat

DETAILED DESCRIPTION OF THE INVENTION

Figure 2:
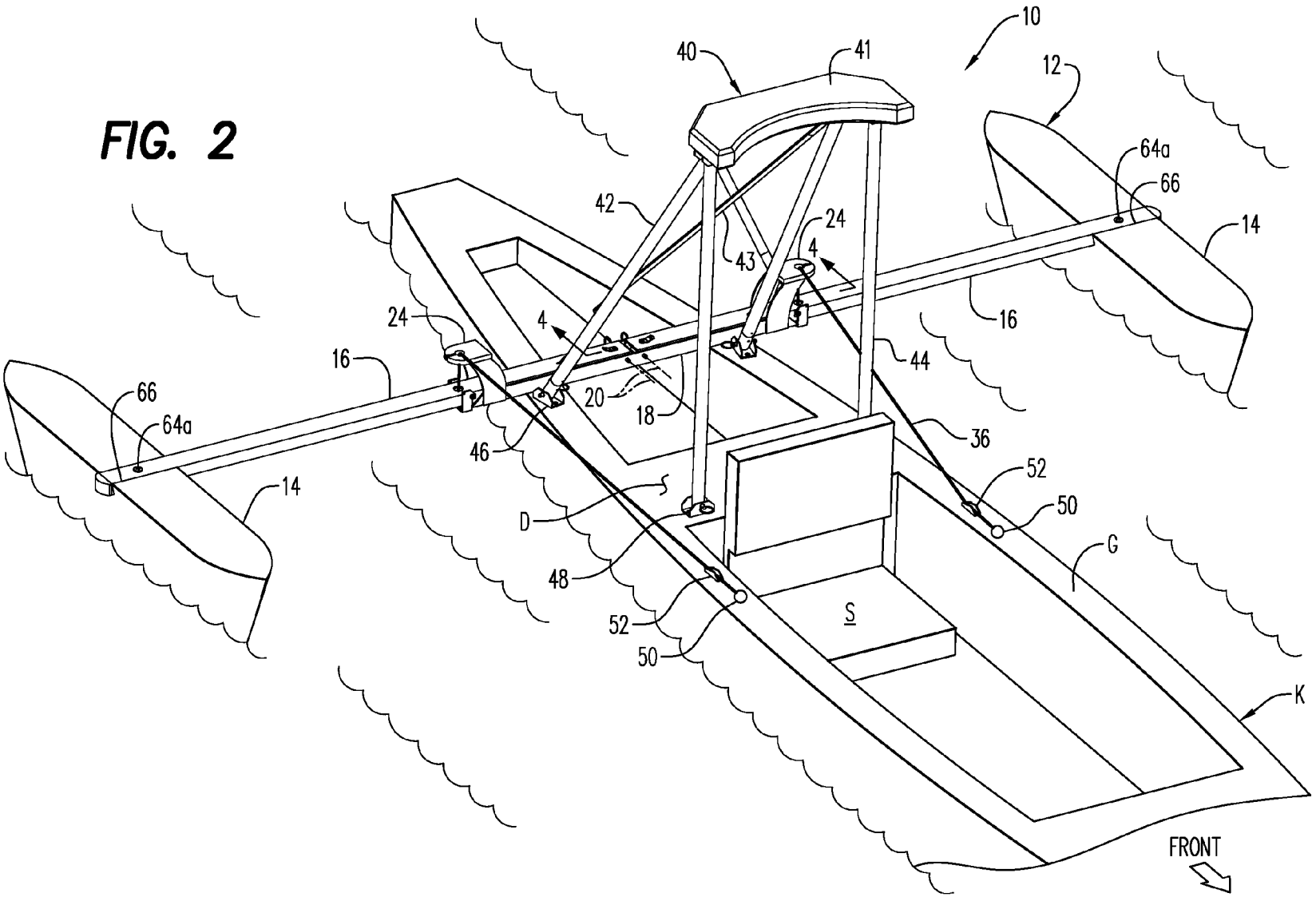
FIG. 2 is another perspective view of FIG. 1 absent the fisherman.
Figure 3:
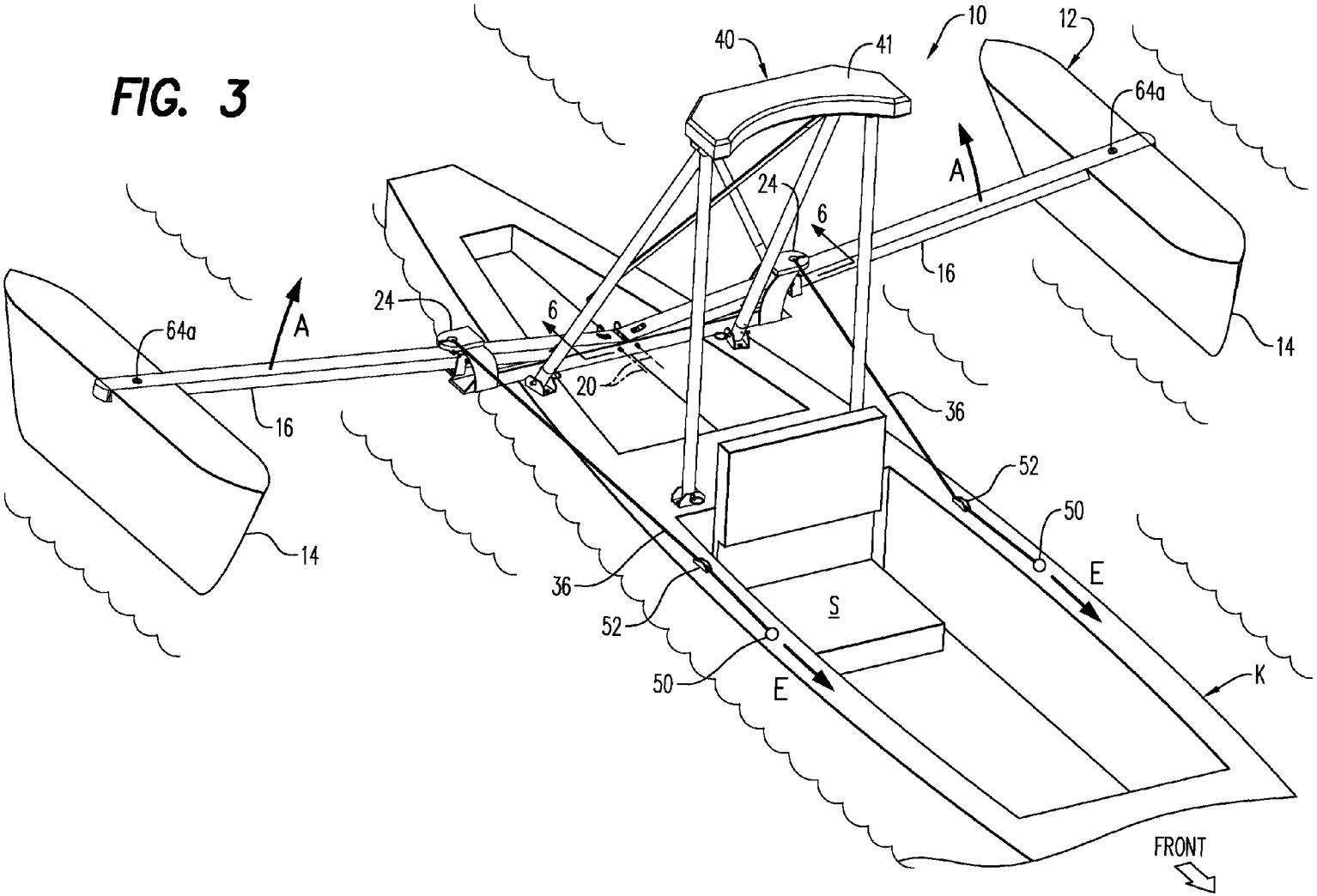
FIG. 3 is a view similar to FIG. 2 with the pontoons partially lifted from the water.

Referring now to the drawings, and firstly to FIGS. 1 to 3, the preferred embodiment of the invention is there shown generally at numeral 10 and generally includes a pontoon assembly 12 and a standing support assembly 40. Each is attached to the deck D of a kayak or canoe K. The preferred location of this installation is toward the rear or the stern of the kayak or canoe K as best seen in FIGS. 2 and 3.

The pontoon assembly 12 includes two elongated buoyant pontoons 14 which are connected by mechanical fasteners 64*a* to the distal ends of two elongated pontoon arms 16 fitted into pontoon mounting slots 66 formed into the central upper surfaces of each of the pontoons 14. Each of the pontoon arms 16 is pivotally connected about the corresponding pivot axis 20 of a release pin 20*a* passing through spaced apertures formed through the sides of a beam support member 18. This beam support member 18 is formed of a u-shaped aluminum channel having tapered ends, the purpose of which is described in FIGS. 4 to 6. The beam support member 18 is mechanically attached by a threaded plurality of threaded fasteners F installed into the deck D adjacent the gunnel G of the kayak or canoe K.

Figures 4, 5, 6:
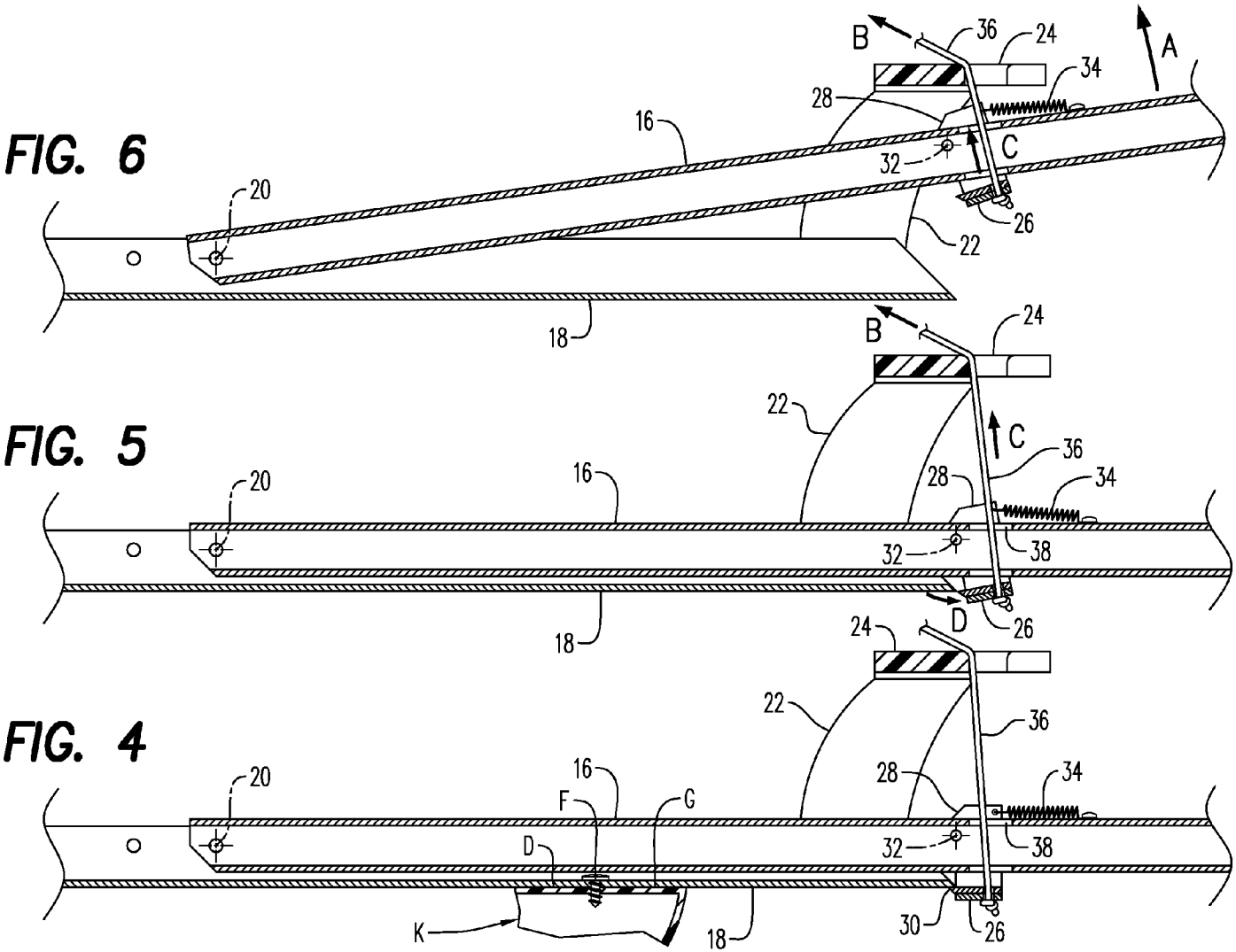
FIG. 4 is a section view in the direction of arrows 4-4 in FIG. 2.
FIG. 5 is a view of FIG. 4 showing the releasing of the latch plate.
FIG. 6 is a section view in the direction of arrows 6-6 in FIG. 3.

Referring now additionally to FIGS. 4 to 6, the pontoons 14 may be selectively lifted from the water as during periods when the kayak or canoe K must be rowed to a fishing site or back to a dock or land. To accomplish the lifting of the pontoons 14, two lengths of lift rope 36 are provided which extend from an aperture formed in latch plate 26 at the bottom of each of two latches 28. Each of the latches 28 are pivotally connected at 32 to one of two pontoon arms 16, the lift rope 36 passing upwardly through a hole 38 and a keyhole shaped slot formed into each rope guide plate 24. By tensioning the lift rope 36 in the direction of arrow B in FIGS. 5 and 6, the pontoon arm 16 will pivot upwardly in the direction of arrow A about the pontoon beam pivot axis 20 and corresponding pivot pin 20*a* shown in FIG. 11 into the lifted position shown in FIG. 6.

As seen in FIG. 4, with the pontoon arms 16 in the fully extended position which places the pontoons 14 into the water, the latch plate 26 is engaged against a latch engagement edge 30 at each tapered end of the beam support member 18. A first movement upon tensioning of each of the lift ropes 36 overcomes the latch 28 biasing provided by latch springs 34, after which the latch plate 26 disengages from the latch engagement 30 in the direction of arrow D in FIG. 5. Continued movement under tension of the lift rope 36 in the direction of arrows B and C cause the pivotal movement of each of the pontoon arms 16 in the direction of arrow A to the upward position in FIG. 6.

As seen in FIGS. 2 and 3, the distal end of each of the lift ropes 36 is held within a deck cam cleat 52. A knob 50 attached to the very distal end of each of the lift ropes 36 facilitates hand grasping and pulling thereof in the direction of arrow E. Each cam cleat 52 holds the position achieved when each of the corresponding knobs 50 is so tensioned and pulled forwardly.

Figure 7:
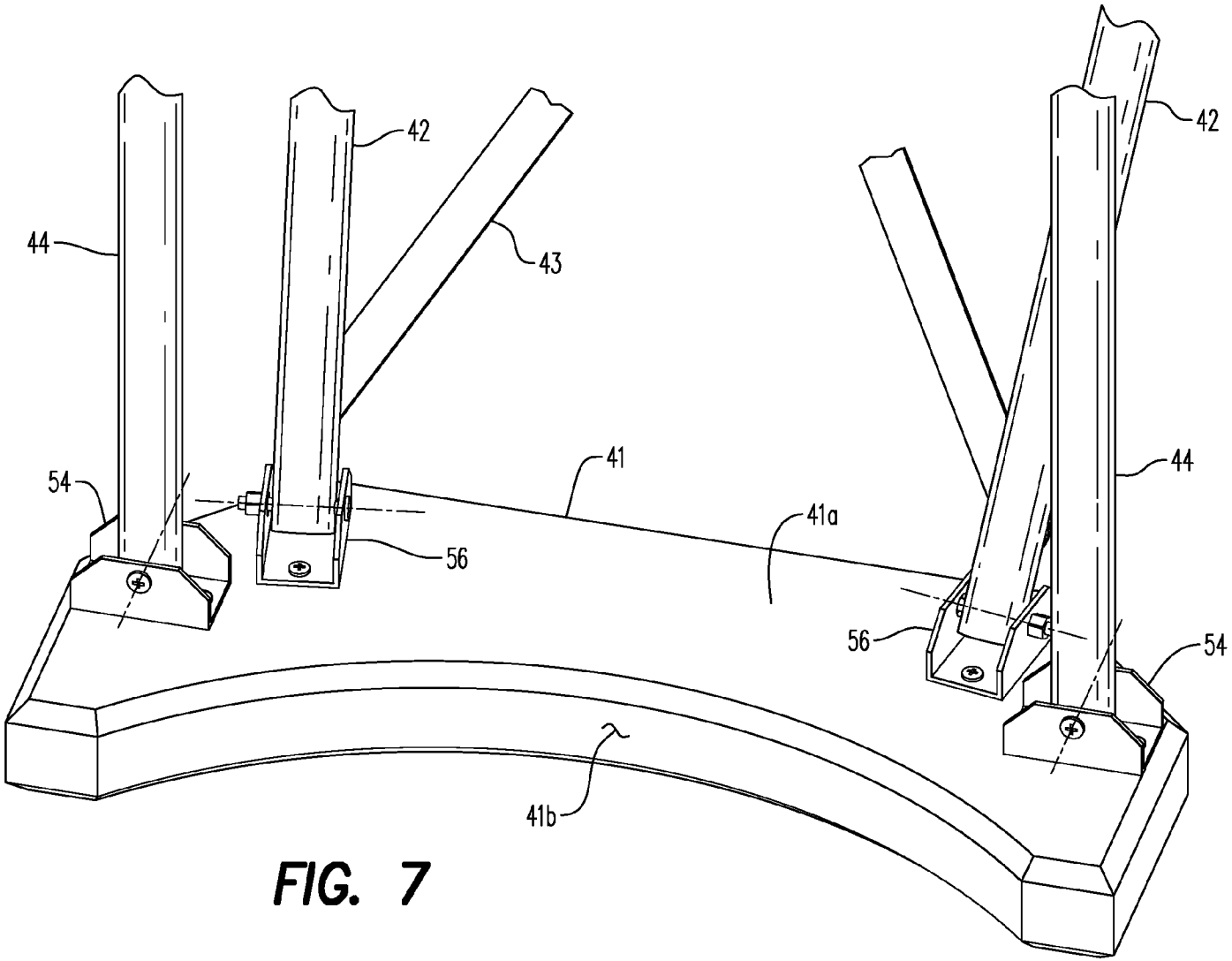
FIG. 7 is a perspective view of the body support in an inverted position showing the attachment of the front and rear struts.

Referring additionally to FIGS. 7 to 10, the body support 41 of standing support assembly 40 includes an arcuately shaped forwardly facing edge 41*b* which, as best seen in FIG. 1, conforms to the front or back side of the mid-torso of a fisherman when standing on seat S during normal fishing activities. The body support 41 is held at a height above the seat so as to make contact with the mid-portion or waist of the fisherman's torso when in a standing position by rear and front struts 42 and 44, respectively. As seen in FIG. 7, the upper ends of each of the rear struts 42 are pivotally connected to rear strut anchors 56 while the upper ends of the front struts 44 are pivotally connected to front strut anchors 54, each of these anchors 54 and 56 being attached by threaded fasteners to the bottom surface 41*a* of the body support 41.

Figure 9:
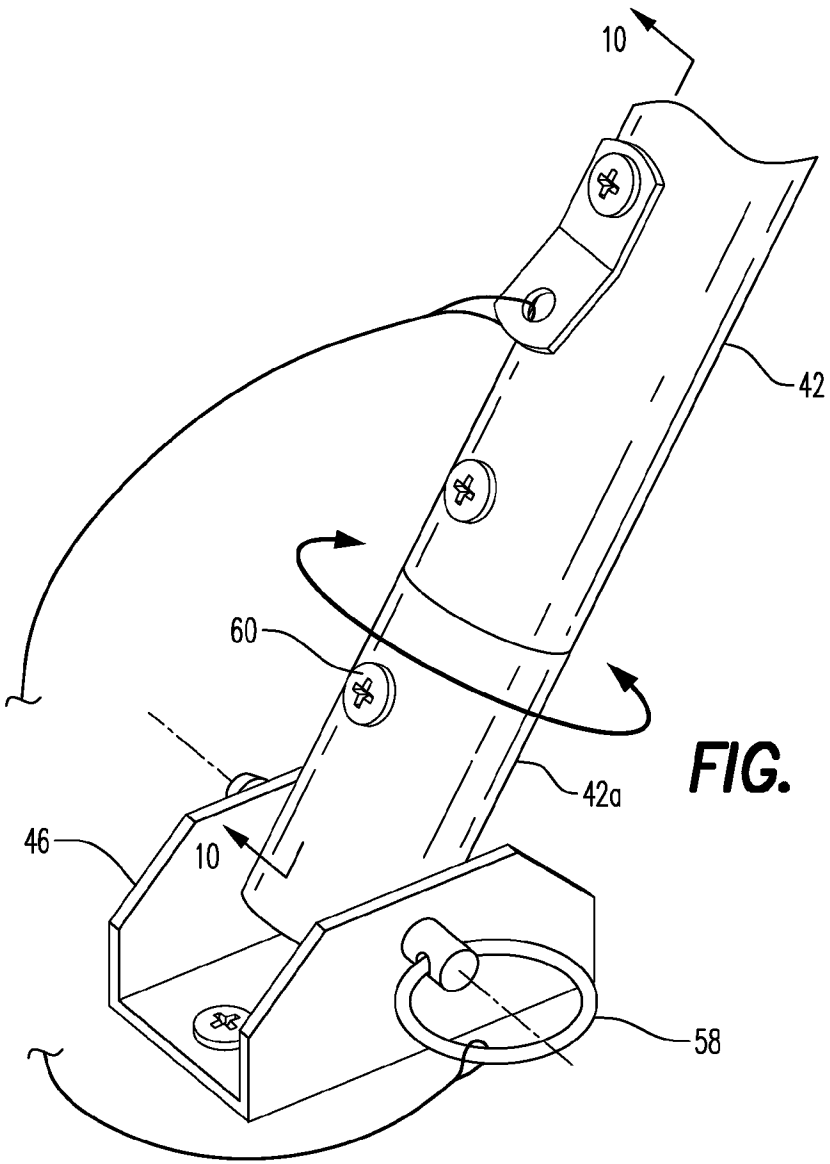
FIG. 9 is a perspective view of the lower end of the rear strut and the rear strut deck anchor.
Figure 8:
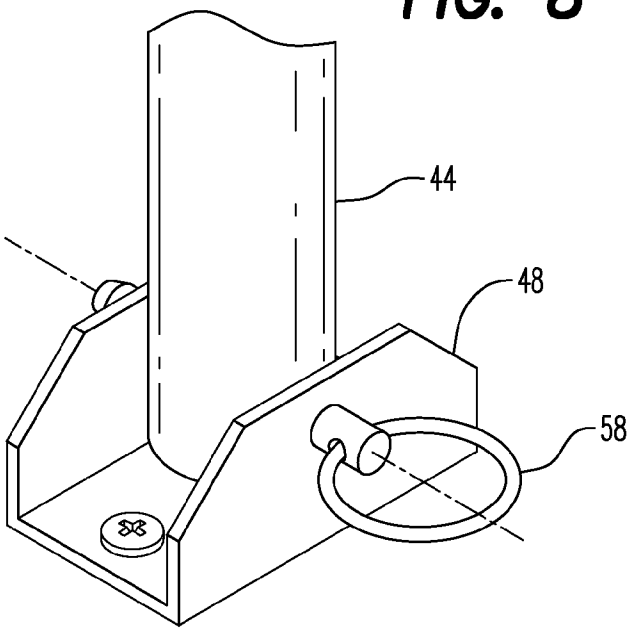
FIG. 8 is an enlarged perspective view of the lower end of one front strut attached to the deck anchor.

As seen in FIG. 8, the lower end of each front strut 44 is pivotally connected to the front strut deck anchor 48 which is screwed to the deck as best seen in FIG. 2. Each front strut 44 is made releasable from the front strut deck anchor 48 by the removal of a release pin 58. In FIG. 9, the lower end of the rear strut 42 is releasably connected to the rear strut deck anchor 46 and is made releasable by the release pin 58. Diagonal braces 43 add lateral strength.

Figure 10:
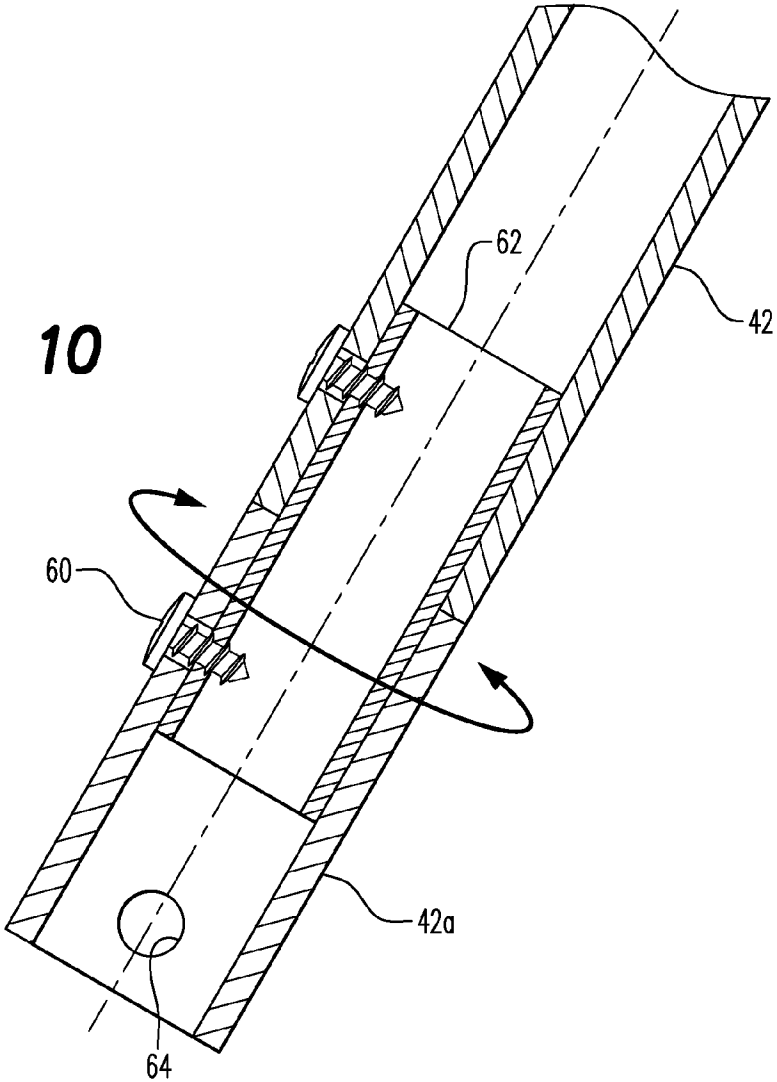
FIG. 10 is a section view in the direction of arrows 10-10 in FIG. 9.

To facilitate proper alignment of the axis of release pin 58 and deck anchor 46 as being generally orthogonal to the axis of the release pin 58 in deck anchor 48, the lower distal end of each rear strut 42 is formed of a separate extension 42*a*. As seen in FIG. 10, the extension 42*a* is spliced to the lower end of the rear strut 42 by an inner reinforcing tube 62 which is screwed into either rear strut 42 or extension 42*a* after which the extension 42*a* is assembled and rotated into proper alignment of release pin hole 64 and the axis defined by the holes in the upright flanges of the deck anchor 46. Thereafter, the other screw 60 is secured to establish the permanent relationship between release pin hole 64 and the front strut anchor 54 attached to the bottom surface 41*a* of the body support 41.

Figure 11:
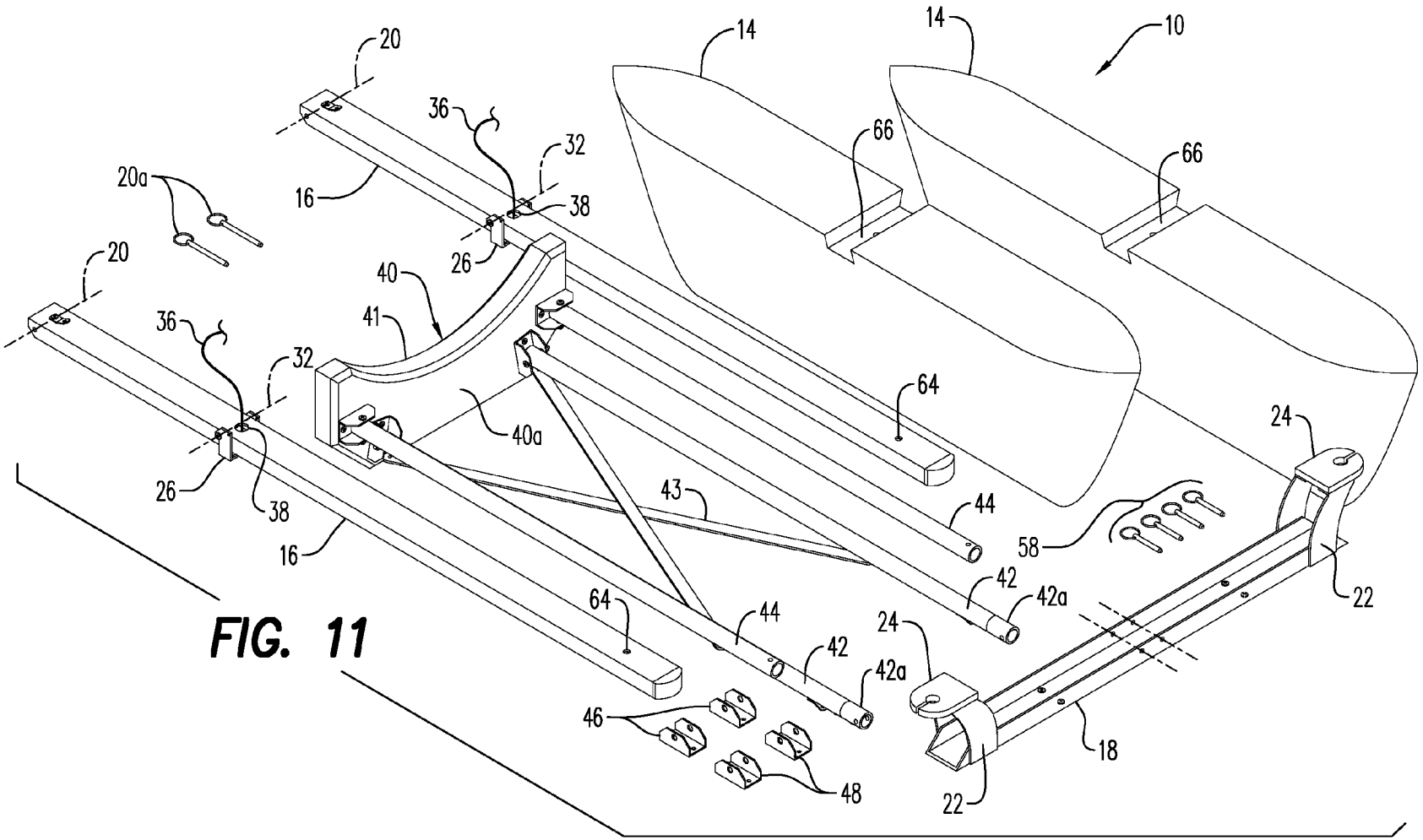
FIG. 11 is a perspective view of all of the components of the pontoon assembly and the standing support assembly.

Referring now to FIG. 11, the invention is intended to be easily deployable onto the kayak or canoe K whenever fishing activity is planned. However, because the components are designed to be easily disassemblable into the arrangement shown in FIG. 11 for storage, the kayak or canoe K may be used in a conventional way absent all of the components there shown. Alternately, the deck anchors 46 and 48 and the beam support member 18 may be left attached to the deck D of the kayak or canoe K without substantial interference with normal kayak or canoe use.

Figure 12:
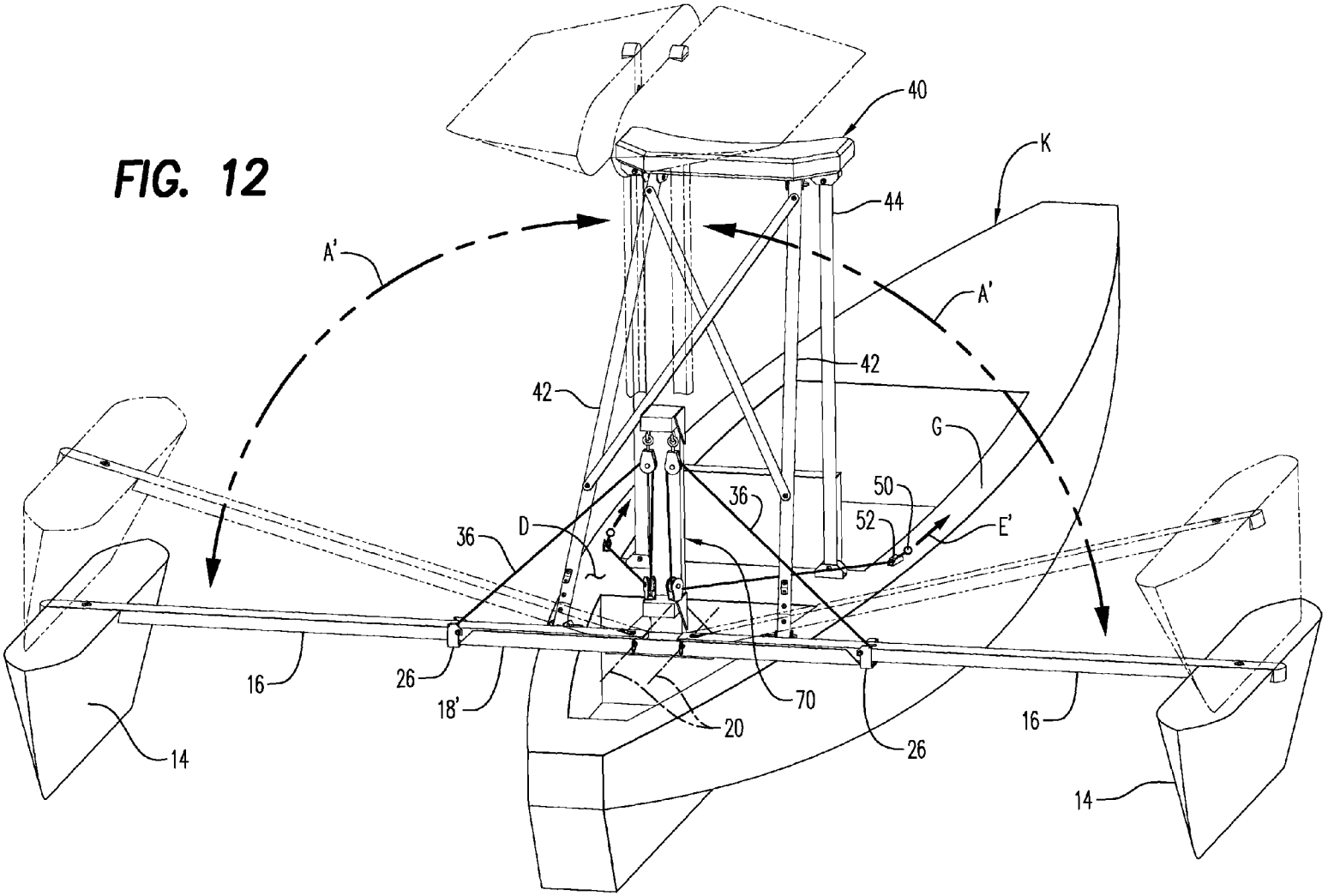
FIG. 12 is a rear perspective view of an alternate embodiment of the pontoon assembly and the standing support assembly operably connected to the deck of a kayak.
Figure 13:
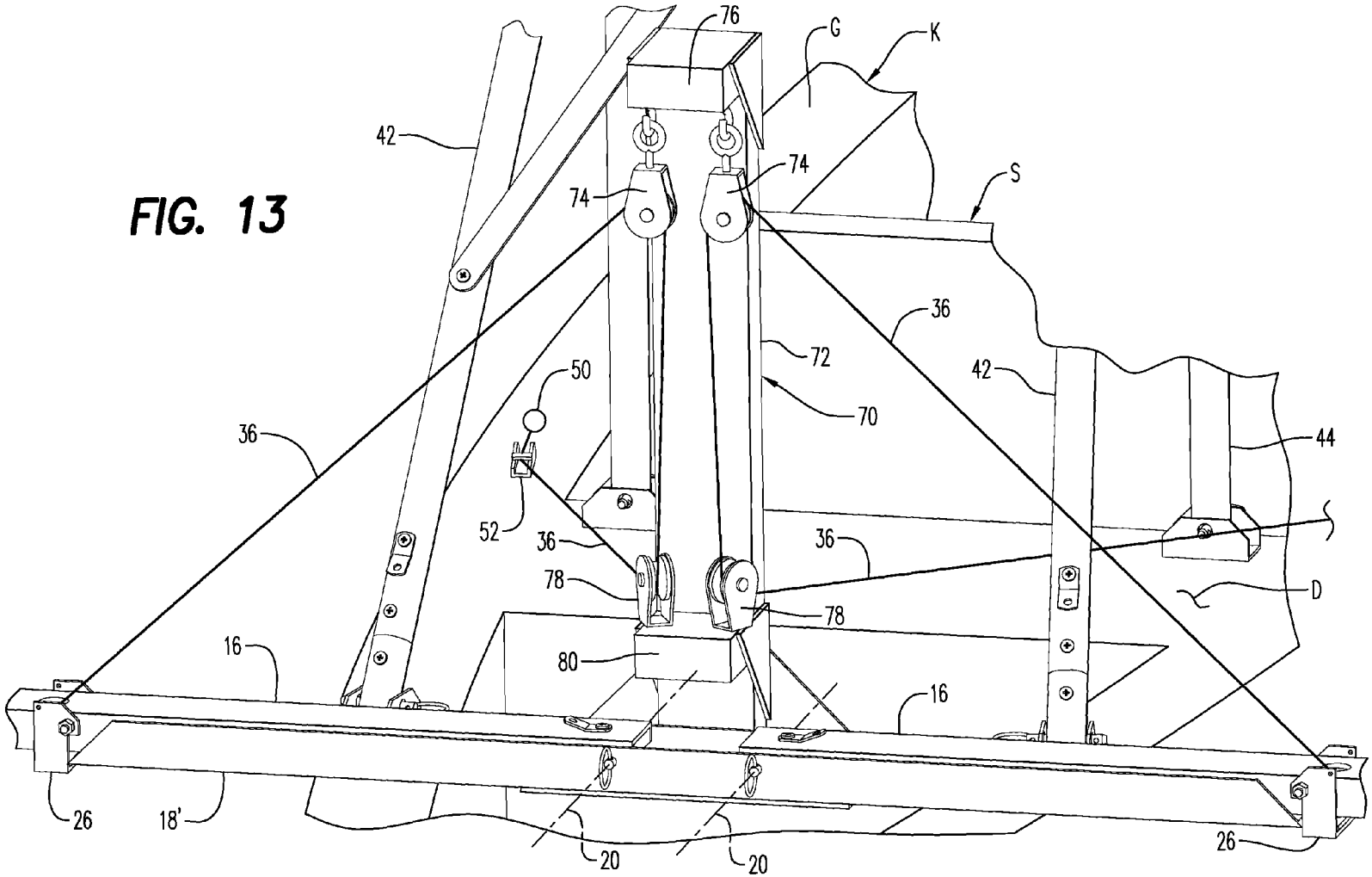
FIG. 13 is an enlarged view of the central portion of FIG. 12.

In certain circumstances, such as in passing through a narrow bridge structure, the pontoons 14 need to be retracted for clearance. Referring now to FIGS. 12 and 13, an alternate embodiment of the invention is there shown and includes a pulley tower 70 which replaces struts 22 attached to each end of the beam support member 18. A lower base 80 of the pulley tower 70 is attached to the center of the beam support member 18' and supports two spaced lower pulleys 78. An upright elongated lower frame 72 attached to lower base 80 supports a tower top 76 which, in turn supports two spaced upper pulleys 74. Lift ropes 36, when tensioned by pulling knobs 50 as previously described, first release the latch plates 26 as previously described and then, further pulling of the knobs 50 will pivot the pontoons 14 upwardly to the position shown in phantom in FIG. 12 above the kayak K. Deck cam cleats 52 hold each of the lift ropes 36 in the desired position to maintain intermediate or fully elevated positions of the pontoons 14.

Figure 14:
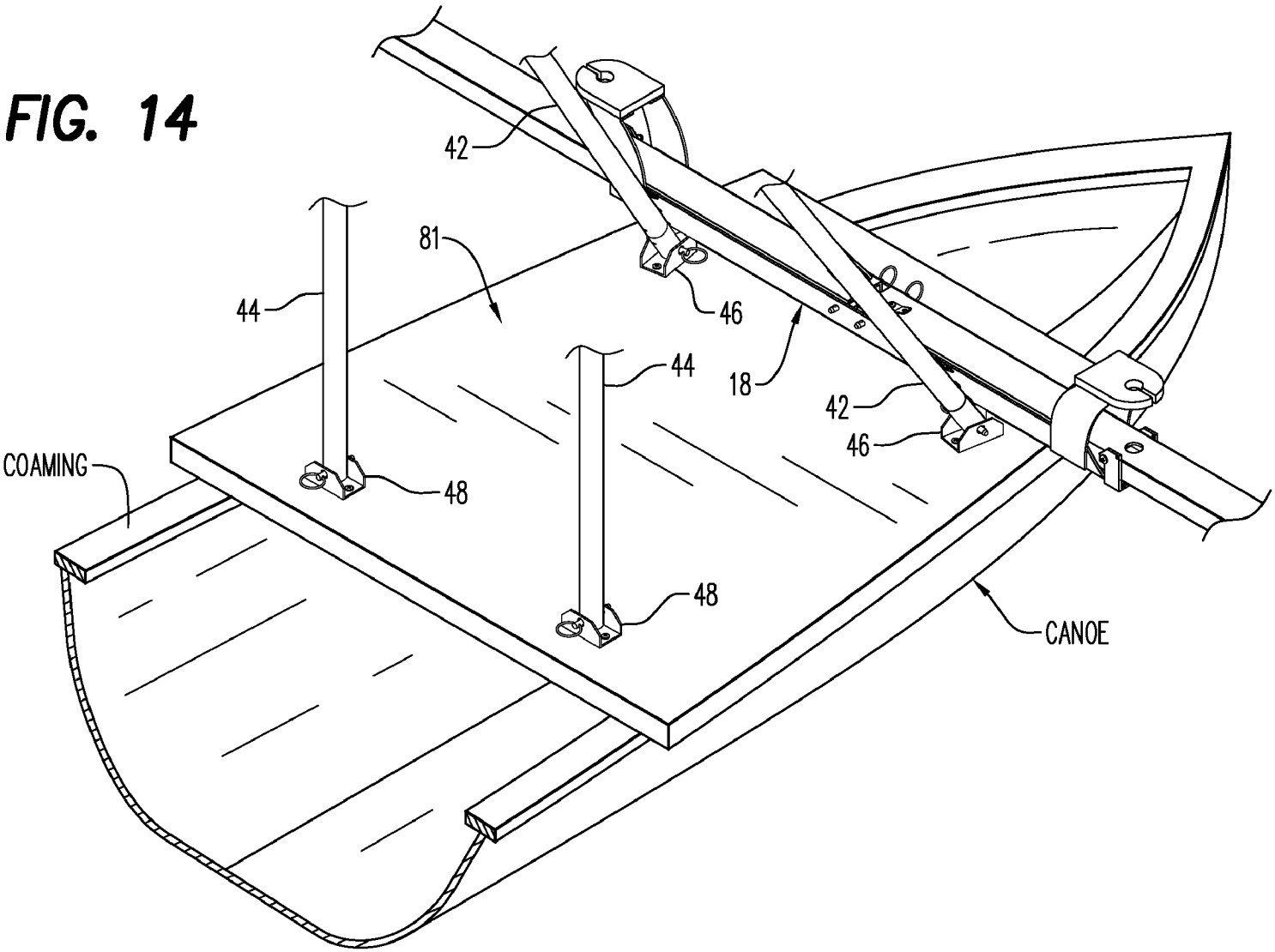
FIG. 14 is a broken perspective view of the invention attached to a canoe.

Referring now to FIG. 14, the invention is shown adapted and connected to the coaming of a canoe. All numbered elements correspond to those previously described with respect to a kayak. However, an additional mounting surface 81 is provided and is attached to the coaming to serve the purpose of the deck previously described for kayaks.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A system for stabilizing a kayak or canoe and for supporting a person fishing while standing in the kayak or canoe comprising:

two elongated pontoon arms, each having a distal end thereof and being connectable to a deck of, and extending laterally from, one side of the kayak or canoe;

two buoyant pontoons each attached to the said distal end of one said pontoon arm whereby the kayak or canoe is stabilized from substantial rolling movement of the kayak or canoe;

a contoured body support rigidly held above a deck of the kayak or canoe by elongated spaced struts releasibly connectable at a lower end of each of said struts to the deck, an upper end of each of said struts attached to said body support and arranged to position said body support at a height sufficient to support a mid-torso area of the person standing in and fishing from the kayak or canoe.

2. A combination stabilizer and standing support for a kayak as set forth in claim 1, further comprising:

a lifting arrangement connected to each of said pontoon arms for lifting said pontoons above the water when not in use.

3. A system attachable to a deck of a kayak or canoe comprising:

an elongated beam support member attachable to the deck or a gunnel of the kayak or canoe;

a pontoon arm pivotally connected at a proximal end thereof to or adjacent to each end of said beam support, one of said pontoon arms extending laterally from each side of the kayak or canoe;

a buoyant pontoon attached to a distal end of each of said pontoon arms;

a locking latch for releasibly locking each of said pontoon arms in a pivotally downwardly deployed position placing said pontoons into water to stabilize the kayak or canoe from substantial rolling movement;

a lifting arrangement connected to each of said pontoon arms for manually lifting said pontoons above the water when not in use;

a contoured body support rigidly held above the deck of the kayak or canoe by elongated spaced struts releasibly connectable at a lower end of each of said struts to the deck, an upper end of each of said struts attached to said body support and arranged to position said body support at a height sufficient to support a mid-torso area of the person standing in and fishing from the kayak or canoe.

* * * * *